US009596544B1

(12) United States Patent
Brotherton

(10) Patent No.: US 9,596,544 B1
(45) Date of Patent: Mar. 14, 2017

(54) HEAD MOUNTED PHASED FOCUSED SPEAKERS

(71) Applicant: Gregory Douglas Brotherton, Los Angeles, CA (US)

(72) Inventor: Gregory Douglas Brotherton, Los Angeles, CA (US)

( * ) Notice: Subject to any disclaimer, the term of this patent is extended or adjusted under 35 U.S.C. 154(b) by 0 days.

(21) Appl. No.: 14/984,116

(22) Filed: Dec. 30, 2015

(51) Int. Cl.
*H04R 5/02* (2006.01)
*H04R 1/28* (2006.01)
*H04R 19/02* (2006.01)

(52) U.S. Cl.
CPC ..... *H04R 5/02* (2013.01); *H04R 1/288* (2013.01); *H04R 19/02* (2013.01); *H04R 2205/024* (2013.01)

(58) Field of Classification Search
CPC .. H04R 2205/024; H04R 1/288; H04R 19/02; H04R 5/02
See application file for complete search history.

(56) References Cited

U.S. PATENT DOCUMENTS

| | | | | |
|---|---|---|---|---|
| 8,654,997 | B2 | 2/2014 | Meehan, Sr. et al. | |
| 9,060,221 | B1 * | 6/2015 | Kaplan | A42B 3/30 |
| 2011/0051962 | A1 | 3/2011 | Cochran | |
| 2012/0201389 | A1 * | 8/2012 | Emerit | H04S 1/002 381/23 |
| 2014/0177846 | A1 * | 6/2014 | Strub | G10L 19/008 381/17 |
| 2015/0254882 | A1 * | 9/2015 | Englert | G02B 27/017 345/633 |

* cited by examiner

*Primary Examiner* — Muhammad N Edun
(74) *Attorney, Agent, or Firm* — Ariel S. Bentolila; Bay Area IP Group LLC

(57) ABSTRACT

A device having first means for directing a sound wave to a first side of a target head location; a first means for encircling the first directing means, being configured to phase focus the sound wave to a proximate center point of a left ear of the listener; a second means for directing the sound wave to a second side of the target head location of the listener; a second means for encircling the second directing means, being configured to phase focus the sound wave to a proximate center point of a right ear of the listener; and means for encapsulating the first and second encircling means, said encapsulating means being configured to proximately surround the target head location of the listener.

20 Claims, 5 Drawing Sheets

HEAD MOUNTED PHASED FOCUSED SPEAKERS

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to audio speakers. More particularly, the invention relates to a speaker phase focused speaker device that may be mounted around a listener's head.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that the playback gear for consumer surround sound or 3D sound "acoustic holography" generally falls into one of two categories, headphones or home theater speakers. In many applications headphones reproduce spatialization using simulated cross talk canceling techniques or binaural recordings. Since headphones are typically worn on the head during use, one may expect that the sound image created by the headphones may be confined within the head and that extended use of headphones may become uncomfortable. Home theater speakers and near field monitors may be able to function in a variety of real spaces to provide a wide listening area yet may exchange accuracy for placement flexibility and overall coverage.

By way of educational background, an aspect of the prior art generally useful to be aware of is that one prior art design provides a helmet-type speaker apparatus and a speaker system for the chair being used by the wearer of the helmet. Other types of audio chairs are also currently available.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic front view of the speaker design. FIG. 1B is a diagrammatic front view of the phase dynamics of the design, and FIG. 1C is a diagrammatic front view of the sound cancelling properties of the design;

FIG. 2A is a front perspective view of the device in use by a listener, and FIG. 2B is a front perspective view of the device without an outer shell;

FIG. 3A is an exploded side view, and FIG. 3B is a side perspective view of phase focused design of two conical speakers;

FIG. 5A is a front perspective view, and FIG. 5B is a diagrammatic side view.

Figure 1A:
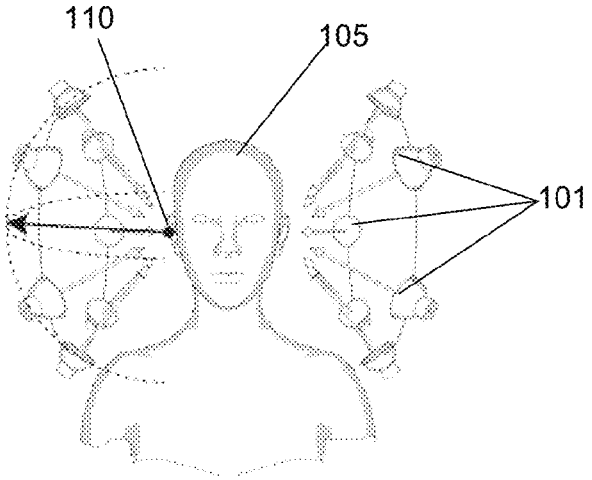
FIGS. 1A through 1C illustrate an exemplary phase focused speaker design comprising multiple drivers, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). The ordinary meaning of "substantially halfway" is thus reasonably close to or nearly at the midpoint between the forwardmost point of the upper or outsole and the rearwardmost point of the upper or outsole.

Similarly, the term "substantially" is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform'. The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, are generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter. Moreover, for any claim of the present invention which claims an embodiment "consisting essentially of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

One embodiment of the present invention may provide a phase focused speaker design that may be mounted around a listener's head for the purpose of enhanced acoustic spatialization in audio playback. In some embodiments the speaker design may comprise a fixed driver array within a framework or enclosure. In some embodiments a phase focusing speaker array may be contained in a fixed framework that may create a spherical sound stage around a listener's head to typically provide a realistic and well defined sense of spatialization.

Figure 1B:
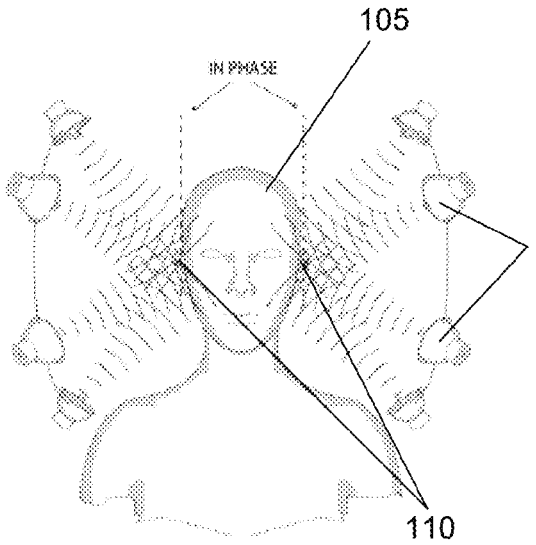
Figure 1C:
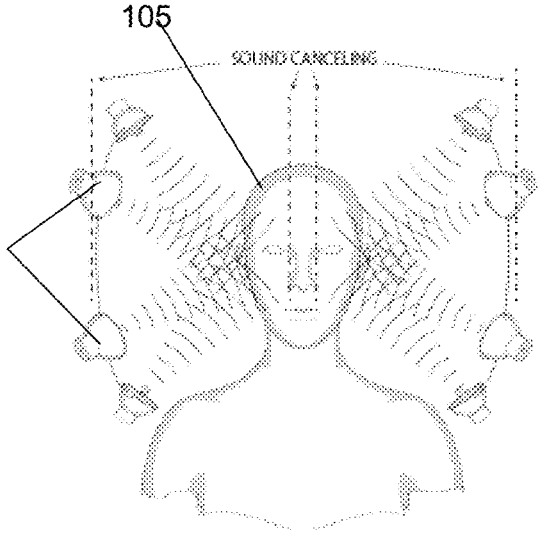

FIGS. 1A through 1C illustrate an exemplary phase focused speaker design comprising multiple drivers 101, in accordance with an embodiment of the present invention. FIG. 1A is a diagrammatic front view of the speaker design. FIG. 1B is a diagrammatic front view of the phase dynamics of the design, and FIG. 1C is a diagrammatic front view of the sound cancelling properties of the design. In the present embodiment, the phase focused speaker design can be achieved by creating two substantially parabolic speakers positioned on either side of a head of a listener 105. In the present embodiment, the speakers may be fitted with multiple speaker drivers 101, which may be positioned radially equidistant from the left and right ears of listener 105. In some embodiments a conical membrane driver may be implemented, as illustrated by way of example in FIGS. 3A through 5B. In the present embodiment, the positioning of drivers 101, or the conical membrane in some embodiments, on a single side should typically be radially equidistant from a center point 110 at an ear and mostly equidistant from each other in the case of multiple drivers 101. For example, without limitation, if you take two equal sized hemispheres, say with a 18" diameter, and center one on the left ear and one on the right ear, the outer shell of the hemispheres would typically describe the possible locations for individual drivers that may be pointed toward the center of their respective spheres. In other words, you would have created two 18" hemispheres approximately 7" apart with the radial centers positioned at the left and right ears and the intersecting plane running front to back of the listener. If you completely enclose this geometry it would be "pill shaped" with the widest points being to the left and right. In the present embodiment, the layout of drivers 101 uses two ring configurations. It is contemplated that a multiplicity of suitable driver layouts may be used in some embodiments in which the drivers may be positioned virtually anywhere radially equidistant from the ears to take advantage of the phase dynamics illustrated by way of example in FIGS. 1B and 1C. In addition, a substantially uniform spacing of the drivers in regards to each other and mirrored left to right may be desirable to provide a balanced sound image. Alternate configurations of an asymmetrical nature may be designed for mimicking the positions of traditional multi-channel surround playback or perhaps for balancing front to back or top to bottom imaging. For example, a variation could have two drivers pushed further in front of the listener while still remaining in the described radial hemispheres to enhance the front image, or larger drivers could be used toward the back for enhanced rear bass. A solid hemisphere of drivers or multiple rings of electro static membranes with varying angels to keep the sound waves focused may be used in larger scale applications. In the present embodiment, two hemispherical arrays that are offset from each other may be configured to create a left and right phase synced areas or virtual speakers.

Referring to FIGS. 1B and 1C, if drivers 101 are fixed around listener 105 within the parameters described in the foregoing and are radiating the same signals in frequency and timing, the radiating sound waves are typically in phase at center points 110 near the ears of listener 105 and out of phase, or canceled, towards the center of the speaker configuration, the sound cancelling zone shown by way of example in FIG. 1C. It is believed that current speaker array configurations typically use constructive interference in a sound field that radiates outward or in a linear dispersion. The design described according to the present embodiment typically uses this technique in reverse to focus the sound field inward, similar to a lens. In the case of current directional speakers, a driver or drivers may be used with a parabolic reflector to produce a linear traveling sound wave. In the present embodiment, the speaker array itself is in a parabolic arrangement, pointing inward, which may create a sound field with constructive interference focused to a single point, center point 110. Constructive interference is generally the interaction of two or more waves of equal frequency and phase, resulting in their mutual reinforcement and producing a single amplitude equal to the sum of the amplitudes of the individual waves. In the present embodiment, the source signal being sent from multiple drivers or positions on a respective side may be delivered to the ear as an amplified but true representation of the phase dynamics of the original sound wave, in effect, causing the sum of the surface area across the individual drivers to act as a single speaker. In the present embodiment, in a phase focused array, mid to high frequency range may be directed, in phase, to a single point at the listener's ear. Aside from producing clear sound, a focused multi-zone array may add a completely new level of audio control that can be used with both constructive and destructive interference to simulate positional information. Depending on the distance from the listener to the speaker, lower frequency signals have too long of a wavelength to be effectively focused and by nature may produce the least amount of spatial cues for discerning position. Furthermore, the left and right sides of the driver array are offset to produce two focal points corresponding to the left and right ears. With the use of multiple drivers 101, the outward radiating sound waves are also canceled at the outer shell of the geometry to help provide external sound dampening. In an embodiment, in the multi driver array, the individual drivers may interfere constructively at the ears but are located at positions that causes the waves to be out of phase in respect to one another. Along the surface of the hemispherical positioning there may be destructive interference or a cancelation effect when all drivers are radiating waves of equal frequency and phase. Moreover, the generally parabolic shape of the array of drivers 101 may be able to phase cancel cross talk without the need for signal processing. The cancelation of cross talk may be desirable in mimicking positional sound. Crosstalk in relation to stereo playback, spatial audio, and/or particularly binaural recording playback refers to the right ear hearing what the left ear is suppose to hear and vice versa. Crosstalk is most pronounced with multiple speakers in a room and compounded by sound reflecting from surfaces in and from the room itself. Headphones are very effective in this type of crosstalk cancelation and have been the best way to experience binaural audio which is audio recorded with two microphones to capture the sound heard by each ear separately. Cross talk can also be transmitted within the speaker electronics before waves are emitted. Binaural playback is also possible with speakers in a room using post processing filtration techniques that cancel cross talk with phase dynamics but is no where near as accurate. In the present embodiment, the offset of the right and left hemispheric positioning of the speakers causes the waves to be out of phase towards the center of the head which causes a cancelation effect or destructive interference. Furthermore, the head itself blocks sound from the speakers on the opposite side and these two factors alone allow for the headphone like experience of spatial sound without using headphones or post processing filtration.

Figure 2A:
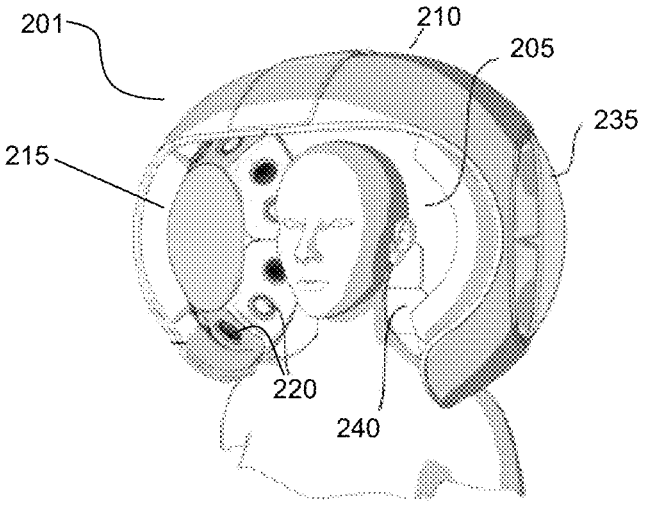
FIGS. 2A and 2B illustrate an exemplary speaker device comprising a phase focused speaker design, in accordance with an embodiment of the present invention.
Figure 2B:
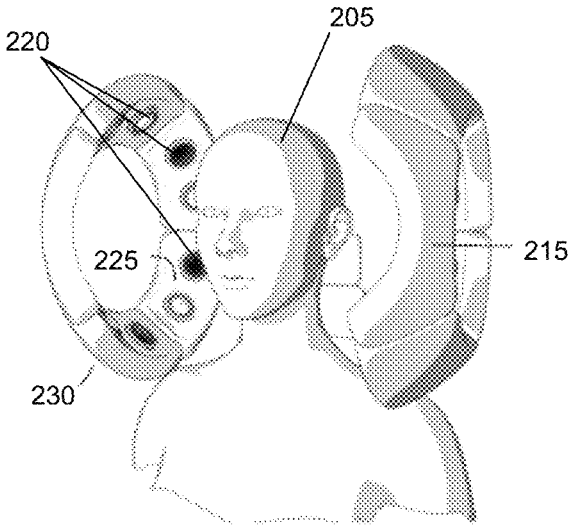

FIGS. 2A and 2B illustrate an exemplary speaker device 201 comprising a phase focused speaker design, in accordance with an embodiment of the present invention. FIG. 2A is a front perspective view of device 201 in use by a listener 205, and FIG. 2B is a front perspective view of device 201 without an outer shell 210. In the present embodiment, device 201 comprises a substantially parabolic speaker ring 215 with an array of full range drivers 220 on both the left and right side. In a typical driver design, facing surfaces 225 and rear surfaces 230 of speaker rings 215 may share the same radial orientation as drivers 220, which may help to minimize out of phase resonance or vibrations. This typically gives speaker rings 215 a dish like face and rounded back. In some embodiments, the speaker drivers may be configured into a faceted design such as, but not limited to, an octagonal or hexagonal design rather than in round rings.

Referring to FIG. 2A, in the present embodiment, outer shell 210 may be shaped to fit around the parabolic shape of speaker rings 215 and to enclose the head of listener 205 without touching the head of listener 205. Those skilled in the art will readily recognize, in light of and in accordance with the teachings of the present invention, that a multiplicity of suitable materials may be used for the outer shell; for example, without limitation, in some embodiments, the outer shell may be vacuum formed from a lightweight thermal plastic, injection molded plastic, various other types of plastics, foam, etc. The outer shell may include, without limitations, coated or molded paper products, specialized laminates like kevlar, carbon fiber, or any type of fiberglass, impact resistant plastics like polycarbonate and acrylic, composites of dissimilar materials like honeycomb aluminum sheet bonded with layers of foam, flexible rubbers or plastics that can be inflated, wood, or wood composites, steel sheet, armor plate, lightweight cast metals like zinc and aluminum, and/or high strength bonded particulates like plaster and concrete. It is further contemplated that the inner surface of outer shell 210 may be lined with various different types of materials for comfort and/or acoustic properties including, without limitation, molded foam, acoustic foam for sound deadening, air cushions, coated or molded paper products, wood or wood composites, fiberglass or foam insulation, fabrics or textiles made from natural or synthetic materials, carpet, etc. Some embodiments may be implemented without any lining materials. In the present embodiment, transparent windows 235 may be placed at the sides of device 201 to help keep the peripheral vision of listener 205 open. It is contemplated that optional foam inserts may be provided in some applications to be placed in windows 235 for sound deadening. Some alternate embodiments may be implemented without windows. In the present embodiment, the use of sound dampening materials within outer shell 210 may enable the sound inside device 201 to be quite loud while being barely heard outside device 201. This sound cancelation may be desirable for professional environments or other types of environments where multiple users may be designing, editing, and listening to audio. In some embodiments, one portion of the speaker ring, for example, without limitation, a forward section, may comprise various different user controls including, but not limited to, volume controls, a microphone, power controls, front and back, top and bottom, and left and right fader controls, tone, bass or bass boost, treble, etc. In additional embodiments, the speaker ring may further comprise, without limitations, headphone bypass port, phone interface, wireless controls like frequency adjustment and/or signal boost, fan and/or heating/cooling environment controls, light and/or led controls. Other embodiments may be implemented without such controls to provide more space for speaker drivers or may place these controls on a different area of the device for example, without limitation, on the outer shell or on a remote control.

Referring to FIG. 2A, device 201 is illustrated by way of example in a chair mounted configuration, which may attach to a headrest 240 or other portion of a chair using a variety of attachment means such as, but not limited to, clamps, velcro straps or hooks. In some embodiments the speaker device may be built directly into a chair. In alternative embodiments, the speaker device may be attached to a molded back cushion that goes in between a user and any type of chair or seat that has back support. In other embodiments, the speaker device may be a standalone unit; for example, without limitation, the device may be mounted on a base that may be placed on the floor to position the device around the head of a listener who may be sitting in a chair or standing. Those skilled in the art will readily recognize, in light of and in accordance with the teachings of the present invention, that some embodiments may be mounted in a variety of convenient and portable configurations while maintaining a predictable and fixed sound stage including, without limitation, attaching to the back of existing office and gaming chairs, self-standing units, units that may rest on the shoulders of a listener in a light weight walk around unit, a unit that may be worn with straps similar to a backpack, hanging from the ceiling, mounted on a wall, mounted on a positionable arm like a monitor mounting arm, etc. Furthermore, some alternate embodiments may comprise a multiplicity of suitable adjustment means for enhanced performance or comfort including, without limitation, means for raising or lowering the device to match the height of the listener, means for pivoting the device about a horizontal and/or vertical axis, means for moving the speaker rings closer to one another or further from one another such as, but not limited to, a sliding mechanism or a collapsible panel near the middle portion of the outer shell, telescoping rods, tension locking pivots, sliding along tracks with interlocking groves or bearings. It is contemplated that some of these mounting means may enable the device to act as a mobile semi-anechoic chamber where most of the surface around the head can be fitted with absorbent and reflection scattering surfaces in conjunction with phase canceling to simulate a semi-anechoic chamber, in which a anechoic or non-echoing chamber is an enclosed space that is designed to absorb the reflections of sound to simulate a quiet open space of infinite dimension.

In the present embodiment, as few as two drivers 220 may be used per side in order to take advantage of the phase benefits of the parabolic configuration when multiple drivers are used, individual drivers may be mapped to multiple zones to reproduce existing formats of surround sound, ambisonic, and octophonic playback, which may provide a versatile listening platform in a single unit. For example, without limitation, in some configurations, at least four drivers 220 may be used to help create a full sense of spatialization and to allow for multiple forms of playback in a single unit including, but not limited to, mono, stereo, binaural, ambisonic octophonic, and up to 5.1 surround sound. In yet other configurations, more than four drivers 220 may be used per side for reproduction of surround sound with a greater resolution than 5.1.

In typical use of the present embodiment, speaker rings 215 may function like two audio magnifying lenses, focusing a broad area of sound waves to single points at the left and right sides of a listener's head. This may enable the sound waves to overwhelm the normal audio directional cues provided to the brain by sound waves interacting with the ear shape and delayed by the head shape, a process referred to herein as head related transfer function that may weaken the illusion of depth in the sound. When minimizing the brain's ability to locate the direction of a sound, the brain is typically more susceptible to the artificial techniques of audio holography. Audio holography is the ability to artificially produce and control the location of a sound or sounds wherein their positions can be discerned by a listener. Some of the techniques used are simply simulating how we hear sound in a natural environment, like the slight delay an audio wave has in reaching the left ear when the sound comes from the right side of the listener and the fact that the wave would be at a slightly lower amplitude because it is partially blocked by the head before reaching the left ear. In a preferred embodiment, sound is focused from a distance outside the head but from an omni-directional source which overwhelms the brains natural cues for determining location. The reflections bouncing around the ear canal can be perceived as coming from a distance but not a direction in relation to the device and the listener, when we then produce artificial delays or amplitude differences between the right and left sides of the device the brain latches on to these as true position cues since there is no clear natural cues to contradict the artificial ones thus strengthening the use of audio holography techniques. Referring to FIG. 2A, the enclosure created by outer shell 201 typically enables listener 205 to freely move his head within the sound field. This may enable listener 205 to take advantage of head positioning to locate sound sources coming from different directions in a multi driver playback of surround sound formats that are simulated between the naturally canceling sides of the speaker array and may also help to minimize effects from biological differences in the head-related transfer function. It is believed that this freedom of head positioning may even work well with binaural playback, which is typically optimized for headphones, by helping to minimize the frequency design incompatibility that can occur with biological variations in ear and head shape. It is contemplated that some embodiments may be implemented without an outer shell or other type of enclosure and may only comprise mounted ring speaker arrays. In some embodiments large versions of this design may be mounted on walls, ceiling, or as free standing units so that the driver array may be shaped and positioned to focus sound on an area for listening such as, but not limited to, a couch or a chair.

Because of the natural phase canceling and omni directional source properties that may be provided by the present embodiment, simple stereo recordings may take on a new depth, sounding more like super stereo experienced by early experiments in ambisonic recording. In typical use of the present embodiment, the sound quality provided by device 201 may rival or exceed some of the most expensive sound systems currently available, in a single unit that may be produced at a fraction of the cost and in some cases may be portable. This is the kind of separation that may be provided by headphone listening where the right and left channels are heard independently. Yet, unlike the use of headphones, both standard and surround variations, which may confine the sound image to the inside of a listener's head, the sound image produced by device 201 may be clearly recognized as outside of the head of listener 205, which may create a larger sound stage and a more immersive listening experience. Furthermore, since device 201 does not contact the head of listener 205, device 201 may be more comfortable than headphones for extended use.

Figure 3A:
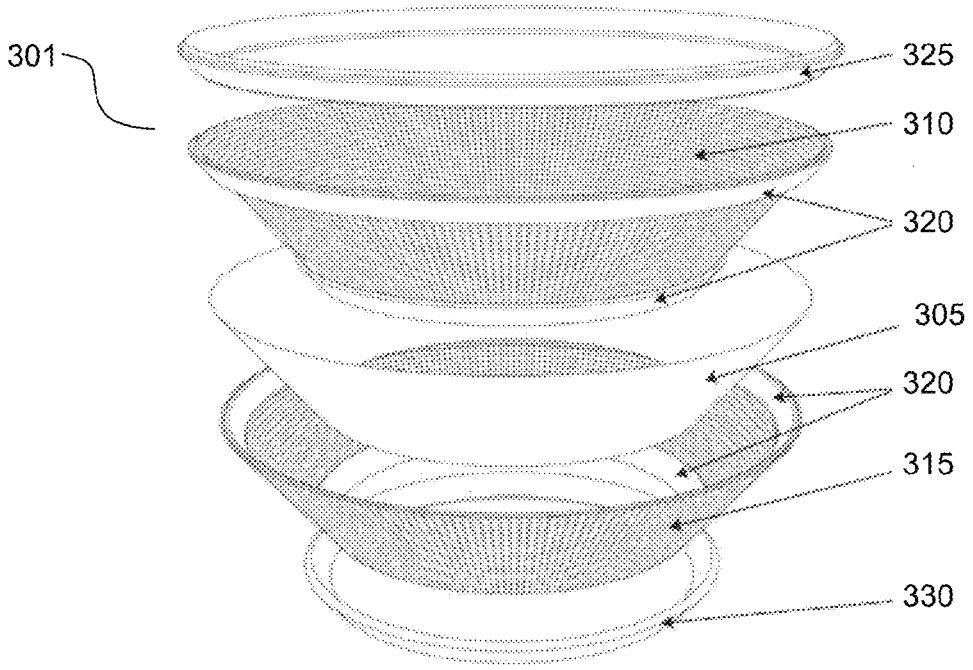
FIGS. 3A and 3B illustrate an exemplary conical electrostatic band speaker with a continuous membrane, in accordance with an embodiment of the present invention.
Figure 3B:
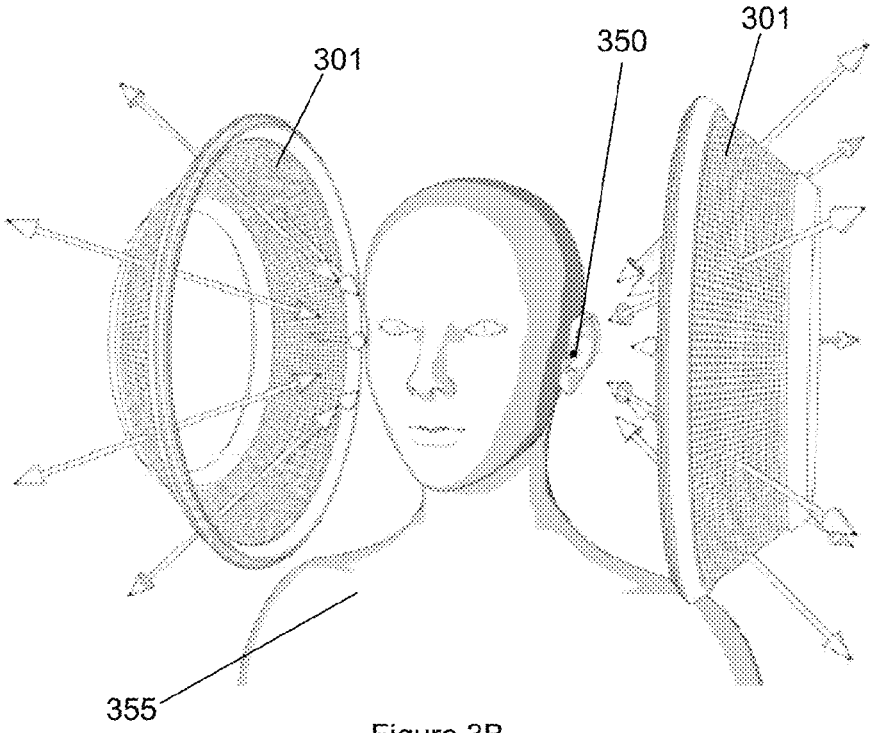

FIGS. 3A and 3B illustrate an exemplary conical electrostatic band speaker 301 with a continuous membrane 305, in accordance with an embodiment of the present invention. FIG. 3A is an exploded side view, and FIG. 3B is a side perspective view of the phase focused design of two conical speakers 301. In the present embodiment, speaker 301 may act as a single driver. In some embodiments a conical electrostatic band speaker may be divided into multiple zones to act as separate drivers, as illustrated by way of example in FIG. 4. In the present embodiment, continuous membrane 305 may be made of thin and flexible material that may be able to conduct an electrostatic charge such as, but not limited to, stretched Mylar®, thin plastic sheeting or any type of synthetic or organic film in the thickness range of 5 to 12 microns that may be sufficiently tensioned and may hold an electrically resistive coating. An inner mesh housing 310 and an outer mesh housing 315 may provide support to a continuous diaphragm or membrane 305. Generally, the membrane 305 may be subjected to a high voltage charge while suspended between and insulated from two charged plates called "stators". The stators or housings 310 and 315 may carry the positive and negative audio signal and attract or repulse the charged diaphragm or membrane 305 causing it to vibrate back and forth to produce audible waves. Stators or Mesh Housings 310 and 315 may be made of a multiplicity of suitable materials including, without limitation, coated steel mesh, aluminum mesh, other types of metal mesh, plastic mesh with a metal coating, copper sheet or copper wire, etc. In other embodiments, the stators may be made of a material that is around 60 percent open for the sound waves to pass through. This may be a mesh material. In an alternative embodiment, copper wire may be used when wound in such a way as to produce a banded mesh of tensioned wire across the entire surface of the diaphragm or membrane 305. The two criteria being that the stator is open enough for sound to pass through and uniformly closed enough to hold a consistent electrical field across the entire surface of the stator. Membrane 305 may be attached to housings 310 and 315 with the use of plastic spacers 320 and adhesive strips or other types of adhesives. An inner frame 325 may be attached to a proximate front edge portion of housing 310 and an outer frame 330 may be attached to a proximate back edge portion of housing 315 once assembled with membrane 305. Inner frame 325 and outer frame 330 may be made of a variety of different materials such as, but not limited to, aluminum, steel, other metals, rigid plastic, flexible plastic, wood, composite materials, coated or molded paper products, specialized laminates like kevlar, carbon fiber, or any type of fiberglass, impact resistant plastics like polycarbonate and acrylic, composites of dissimilar materials like honeycomb aluminum sheet bonded with layers of foam, flexible rubbers or plastics that can be inflated, wood, or wood composites, steel sheet, armor plate, lightweight cast metals like zinc and aluminum, and/or high strength bonded particulates like plaster and concrete, etc.

In a traditional speaker driver, the entire cone typically moves up and down perpendicularly to a moving magnet causing a pressure wave to radiate outward linearly. Referring to FIG. 3B, with the use of an electrostatic conical plane in the present embodiment, the membrane radiates perpendicularly to the conical plane causing the pressure wave to constructively focus at a center point 350, which in this configuration is near the ears of a listener 355. The use of conical continuous membrane electrostatic band speaker 301 may enhance the phase focusing effect of the parabolic speaker array by virtually eliminating the small frequency dead spots associated with multi driver arrays. It is contemplated that multiple concentric rings of continuous membrane speakers may be nested in some embodiments to create a higher resolution sound environment. In other embodiments, continuous membrane speaker may be utilized to radiate sound outward from the back rather than focusing sound inward to a center point. This may enable the speaker to create a focused ring of sound that may be projected from overhead or below or from a wall, etc.

Figure 4:
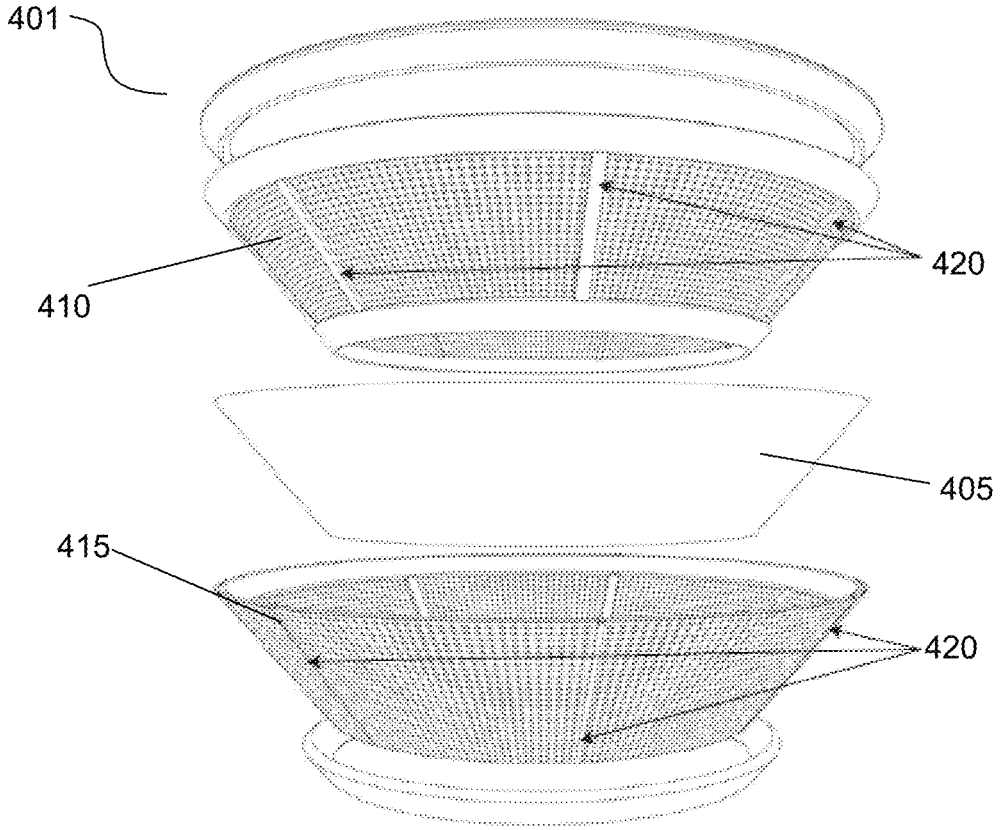
FIG. 4 is an exploded side view of an exemplary conical electrostatic band speaker divided into multiple zones, in accordance with an embodiment of the present invention.

FIG. 4 is an exploded side view of an exemplary conical electrostatic band speaker 401 divided into multiple zones, in accordance with an embodiment of the present invention. In the present embodiment, speaker 401 comprises a continuous membrane 405 between an inner housing 410 and an outer housing 415. Spacers 420 placed on both sides of membrane 410 may create corresponding breaks in the conductive material of membrane 410, in turn may create corresponding breaks in the conductive membrane 405 at these junctions. The breaks in the conductive membrane 405 may also provide divisions that allow for the wiring of multiple signals provided that the stators on either side of the membrane are also divided into sections or have a break in their conductive coating at the spacers and are wired to separate signals 405 at these junctions. The breaks in the conductive material of membrane 405 may also provide space for wiring for multiple signal zones. Divisions in the tensioned membrane wherein the physical structure is pressed against a rigid spacer divides the membrane into sections that can move back and forth to produce vibrations with different frequency responses from one another due to different amounts of surface area. Smaller sections will have a better high frequency response while larger sections will have a better low frequency response. This division of the movable membrane into different sections can be used to fine tune the frequency response of a single signal or can be used to produce vibrations from multiple signals provided that the stators on either side of the membrane also have a break in their conductive material at the spacers and are wired to separate signals. Electrostatic driver wiring consists of three wires going to the driver, a positive audio signal going to one stator a negative signal going to a second stator and a constant positive charge going to the membrane in between. So wiring in a multi zoned conical speaker would consist of a positive audio signal going to one section of stator, the corresponding negative signal going to the facing section of stator and the membrane between them receiving a constant positive charge across all the sections of membrane. Each of these sections when wired separately would be able to receive a different audio signals. Any number of individual speakers may be created by adding spacers 420 within speaker 401. Dividing the speaker in this manner may allow for various zones of speaker 401 to correspond to multi driver speaker designs and multi speaker playback for various surround sound formats of surround sound, ambisonic, and octophonic playback. For example, without limitation, in some configurations, speaker 401 may be divided into at least four zones to provide a full sense of spatialization and to allow for various different playback forms such as, but not limited to, mono, stereo, binaural, ambisonic octophonic, up to 5.1 surround sound, etc. In other configurations, as few as two zones may be used per side in order to take advantage of the phase benefits of the conical shape of speaker 401. In yet other configurations, more than four zones may be used per side for reproduction of surround sound with a greater resolution than 5.1. Further, dividing speaker 401 into multiple zones may be able to reproduce multi speaker playback formats with far more accuracy than a typical surround sound set up since the conical shape of speaker 401 may enable the sound to be focused on a center point, and the fixed positioning of the speaker array typically does not need to account for room acoustics. A multi zoned conical shaped electrostatic speaker will phase focus sound waves in the same way that a single zoned version will, but instead of focusing across the entire surface of the speaker the effect will be localized to individual sections or the speaker. All zones will focus their individual signals to an in phase point from the waves generated across the surface area of the zone but these zones will not benefit from wave interference in regards to each other wherein dissimilar signals are being sent. Cancelation will behave in a similar manner as it will be applicable to individual signals but not in regards to an interaction of multiple dissimilar signals with each other.

Figure 5A:
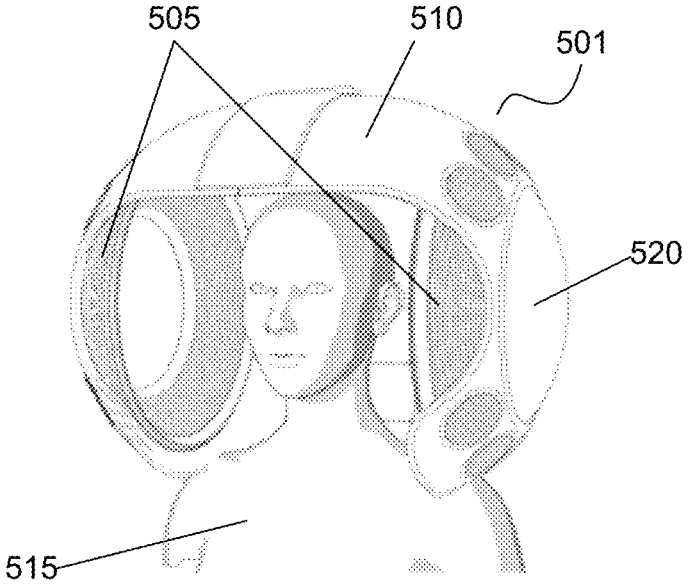
FIGS. 5A and 5B illustrate an exemplary phase focused speaker device comprising conical electrostatic continuous membrane speakers, in accordance with an embodiment of the present invention.
Figure 5B:
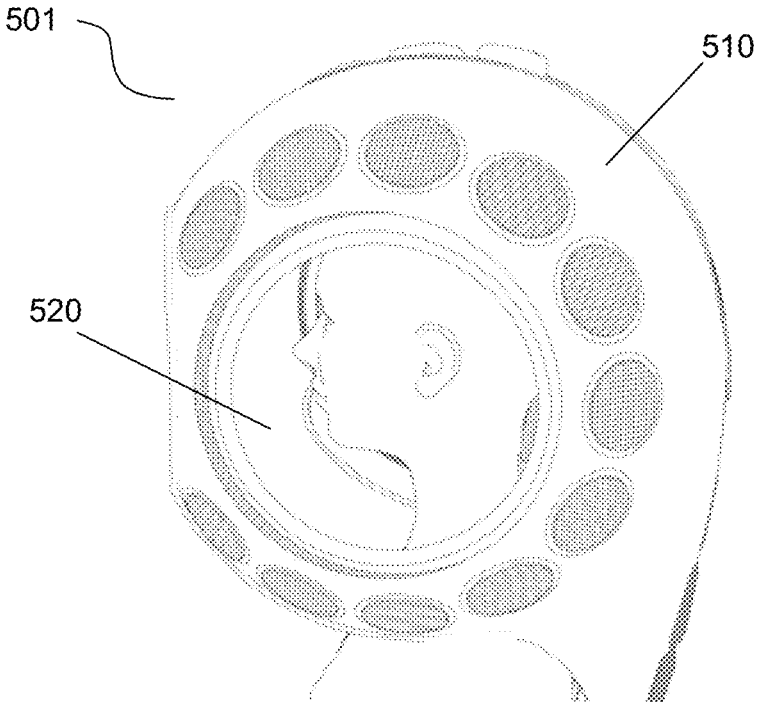

FIGS. 5A and 5B illustrate an exemplary phase focused speaker device 501 comprising conical electrostatic continuous membrane speakers 505, in accordance with an embodiment of the present invention. FIG. 5A is a front perspective view, and FIG. 5B is a diagrammatic side view. In the present embodiment, a shell 510 having an inner and outer surface area may be utilized to integrate or incorporate the conical shape speakers 505 in a proximate spherical sound stage around the listener's head and provide enhanced acoustic spatialization in audio playback. The shell 510 may be shaped to fit around the conical shape speakers 505 and to enclose the head of a listener 515 without touching the head of listener 515. The conical shape speakers will be fixed within the shell or any holding apparatus by means of mechanical fasteners, adhesives or integrated partially or entirely within the molding of the shell material itself in order to keep the speakers properly aligned in relation to a listener's head. Adjustments to locations of the speakers will be made by adjustments of the positioning of the shell portion or holding apparatus of the device by means of adjustable brackets or fittings within the mounting hardware that attaching the device to a chair, a stand, a floor base, or to the body of the listener. Those skilled in the art will readily recognize, in light of and in accordance with the teachings of the present invention, that a multiplicity of suitable materials may be used for shell 510 including, without limitation, various different plastics, foam, composite materials, etc. Since the sound waves produced by speakers 505 radiate both inward and outward, sound cancelling or dampening materials may be placed on the inner or outer surface portion of shell 510 in applications in which it may be desirable to help prevent sound from escaping the enclosed area of device 501. A sound source such as the audio output from a consumer device, or speaker signals from an amplifier or wireless receiver will plug into the headspace device via a stereo input jack, HDMI connector, RCA plugs, multiple wire lugs or other compatible audio interface. On a chair mounted unit the entire shell may be able to pivot forward or backwards at the base of the shell and also slide up and down to accommodate listeners of different heights and different positions of recline. The unit may also be able to swing completely backwards on a chair to sit behind the listener when not in use. Different types of detachable mounting latches or clamps can work for various popular office and gaming chairs or a detachable padded backrest board can be used behind the listener to work on most other types of chairs or couches. A floor mounted adjustable stand could be employed for standing listening or used behind a chair or next to a bed.

Those skilled in the art will readily recognize, in light of and in accordance with the teachings of the present invention, that some embodiments may be used in a multiplicity of suitable applications for example, without limitation, by studios and professionals for designing, editing, and using audio including, but not limited to, film editors, recording engineers, sound designers, musicians, and game designers, in virtual reality or computer gaming applications, for home theaters or other entertainment applications, for telepresence, for sonar listening, for drone and remote control applications, in space helmets or other extreme environment suits, as part of sensory deprivation applications, etc. In one exemplary application, a phase focusing speaker design according to an embodiment of the present invention may be used in amps and monitors for live music by focusing the array at a microphone. In these applications along with other applications using monophonic sound reproduction, it may be possible to use a single speaker driver focusing to a point. In another exemplary application, a conical electrostatic speaker similar to those illustrated by way of example in FIGS. 3A through 4 may be used around a base driver for a full range version. Mobile units may be used when controlling robots or drones that are miked for directional sound, which may aid in search and rescue or military operations. In some embodiments a phase focused design may be mounted inside a helmet to provide audio directional cues in suits miked for sound, for example, without limitation, suits used in hazardous environments or poisonous atmospheres. In other embodiments phase focused speaker systems may be mounted inside vehicles to provide audio directional cues in vehicles miked for sound, such as, but not limited to, tanks, robotic suits, race cars, airplanes, etc. In yet another embodiment, a large electrostatic high powered conical speaker may be used to weaponize and focus audible sound.

Furthermore, those skilled in the art will readily recognize, in light of and in accordance with the teachings of the present invention, that various different additional or alternate features may be included, without limitation, in some alternate embodiments such as, but not limited to, attached video displays, attached game controllers or remote controls, internal lighting, Bluetooth® capabilities, multiple types of media input means, such as, but not limited to, USB ports, audio jacks, and Wi-Fi connections, etc. Some alternate embodiments may comprise a shade to cover the open portion of the outer shell or other type of means for fully enclosing the device. These embodiments may provide a more immersive experience. Some of these embodiments may also comprise a video display or means for projecting video onto this shade. Other alternate embodiments may comprise fans to help keep the listener and/or the components of the device cool. Yet other embodiments may be collapsible so that the device may be easily stored or transported when not in use.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a phase focused speaker device that may be mounted around a listener's head according to the present invention will be apparent to those skilled in the art. Various aspects of the invention have been described above by way of illustration, and the specific embodiments disclosed are not intended to limit the invention to the particular forms disclosed. The particular implementation of the phase focused speaker device may vary depending upon the particular context or application. By way of example, and not limitation, the phase focused speaker devices described in the foregoing were principally directed to implementations comprising a pair of phase focused speaker arrays; however, similar techniques may instead be applied to devices comprising more than two speaker arrays, for example, without limitation, devices that comprise clusters of three or four phase focused speaker arrays or multiple concentric phase focused speaker arrays on each side, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A device comprising:

a first speaker ring being comprised of at least a first generally parabolic shaped speaker, wherein said first speaker ring is configured to substantially encircle the first generally parabolic shaped speaker and being further configured to be positioned to a location proximal to where a first side of a head of a listener would be located during normal use of said device, wherein said first generally parabolic shaped speaker is configured to be operable to at least phase focus sound waves to a proximate center point of a location proximal to where a left ear of the listener would be located during normal use of said device, the first generally parabolic shaped speaker comprising:

a first driver being disposed proximate to a location proximal to where a left ear of the listener would be located during normal use of said device, said first driver comprises at least a first conical electrostatic band speaker;

a second speaker ring comprise of at least a second generally parabolic shaped speaker, wherein the second speaker ring being configured to encircle the second generally parabolic shaped speaker and being further configured to be positioned on a second side of the location proximal to where a head of a listener would be located during normal use of said device, wherein the second generally parabolic shaped speaker being configured to be operable to at least phase focus the sound waves to a proximate center point of a location proximal to where a right ear of the listener would be located during normal use of said device, the second generally parabolic shaped speaker comprising:

a second driver disposed proximate to a location proximal to where a right ear of the listener would be located during normal use of said device, said first driver comprising at least a second conical electrostatic band speaker; and a shell, said shell being configured to substantially encapsulate the first and second speaker rings and to generally surround the location proximal to where the head of the listener would be located during normal use of said device, the shell being further configured to be operable to at least create a proximate spherical sound field around a location proximal to where the listener's head would be located during normal use of said device, said shell comprising:

an inner surface having a sound wave absorbing material being configured to be operable to at least absorb scattered sound waves and to simulate a semi-anechoic chamber.

2. The system of claim 1, wherein each of the first and second speaker rings further comprise of at least two or more drivers, said at least two or more drivers being configured to reproduce at least two or more formats of surround sound.

3. The system of claim 1, in which the first and second conical electrostatic band speaker each comprises a continuous membrane made of at least a thin and flexible material being configured to be operable at least conduct an electrostatic charge or be sufficiently tensioned and hold an electrically resistive coating.

4. The system of claim 3, in which the first conical electrostatic band speaker further comprises at least a first inner and outer mesh housing, each of the first inner and outer mesh housing being configured to be operable to at least pass sound through, and to at least hold a consistent electrical field across the entire surface of the mesh housing.

5. The system of claim 4, in which the second conical electrostatic band speaker further comprises at least a second inner and outer mesh housing, each of the second inner and outer mesh housing being configured to be operable to at least pass sound through and to at least hold a consistent electrical field across the entire surface of the mesh housing.

6. The system of claim 5, in which the first and second conical electrostatic band speaker, each further comprises at least an inner frame attached to a proximate front edge of the inner housing and at least an outer frame attached to a proximate back edge portion of the outer housing.

7. The system of claim 1, in which each of the first and second driver further comprises multiple conical electrostatic band speakers, and wherein sound waves emanating out of the multiple conical electrostatic band speakers of the second driver being configured to be phase focused to a proximate single center point near the location proximal to where the right ear of the listener would be located during normal use of said device.

8. The system of claim 7, in which sound waves emanating out of the multiple conical electrostatic band speakers of the first driver being configured to be phase focused to a proximate single center point near the location proximal to where the left ear of the listener would be located during normal use of said device.

9. The system of claim 1, in which an outer surface of the shell comprises at least a sound wave cancelling or dampening material being configured to be operable to prevent sound waves from escaping the enclosed area of the shell.

10. A device comprising:

means, a first, for directing a sound wave to a first side of a location proximal to where a head of a listener would be located during normal use of said device;

means, a first, for encircling the first directing means, the first encircling means being configured to phase focus the sound wave to a proximate center point of the location proximal to where a left ear of the listener would be located during normal use of said device;

means, a second, for directing the sound wave to a second side of the location proximal to where the head of the listener would be located during normal use of said device;

means, a second, for encircling the second directing means, the second encircling means being configured to phase focus the sound wave to a proximate center point of a location proximal to where a right ear of the listener would be located during normal use of said device; and means for encapsulating the first and second encircling means, said encapsulating means being configured to proximately surround the location proximal to where the head of the listener would be located during normal use of said device, said encapsulating means comprises sound wave absorbing means to provide a semi-anechoic chamber.

11. The system of claim 10, in which each of said first and second directing means comprises means for conducting an electrostatic charge, said conducting means being configured to be operable to be tensioned and hold an electrically resistive coating.

12. The system of claim 11, in which each of said first and second directing means comprises means for passing sound through, said sound passing means being configured to be operable to hold a consistent electrical field across the entire surface of the sound passing means.

13. A device comprising:

a first generally parabolic shaped speaker being configured to at least be positioned on a first side of the location proximal to where a head of a listener would be located during normal use of said device, the first generally parabolic shaped speaker being operable to direct sound to the first side of the location proximal to where the head of the listener would be located during normal use of said device, the first generally parabolic shaped speaker comprises;

a first driver being disposed proximate a left ear of the location proximal to where the listener would be located during normal use of said device, said first driver comprises at least a first conical electrostatic band speaker;

a second generally parabolic shaped speaker positioned on a second side of the location proximal to where a head of a listener would be located during normal use of said device, the second generally parabolic shaped speaker being operable to direct sound to the second side of the location proximal to where the head of the listener would be located during normal use of said device, the second generally parabolic shaped speaker comprises;

a second driver disposed proximate to the location proximal to where a right ear of the listener would be located during normal use of said device, said first driver comprises at least a second conical electrostatic band speaker; and a shell being configured to encapsulate the first and second generally parabolic shaped speakers and to generally surround the location proximal to where the head of the listener would be located during normal use of said device, the shell comprises an inner surface having a sound wave absorbing material being configured to be operable to absorb scattered sound waves, and to simulate a semi-anechoic chamber.

14. The system of claim 13, in which the first and second conical electrostatic band speaker each comprises at least a continuous membrane made of at least a thin and flexible material being configured to be operable to at least conduct an electrostatic charge, be tensioned, and hold an electrically resistive coating.

15. The system of claim 14, in which the first conical electrostatic band speaker further comprises a first inner and outer mesh housing, the first inner and outer mesh housing, each being configured to be operable to pass sound through and hold a consistent electrical field across the entire surface of the mesh housing.

16. The system of claim 15, in which the second conical electrostatic band speaker further comprises at least a second inner and outer mesh housing, each of the second inner and outer mesh housing being configured to be operable to at least pass sound through and hold a consistent electrical field across the entire surface of the mesh housing.

17. The system of claim 16, in which each of the first and second conical electrostatic band speaker comprises at least an inner frame attached to a proximate front edge of the inner housing and at least an outer frame attached to a proximate back edge portion of the outer housing.

18. The system of claim 13, in which the first driver further comprises at least multiple conical electrostatic band speakers, and wherein sound waves of the multiple conical electrostatic band speakers of the first driver being configured to be phase focused to a proximate single center point near the location proximal to where right ear of the listener would be located during normal use of said device.

19. The system of claim 18, in which sound waves of the multiple conical electrostatic band speakers of the second driver being configured to be phase focused to a proximate single center point near the location proximal to where left ear of the listener would be located during normal use of said device.

20. The system of claim 13, in which the shell further comprising at least a sound cancelling or dampening material placed on an outer surface of the shell being configured to be operable to prevent sound from escaping the enclosed area of the shell.

* * * * *